United States Patent [19]

Kuusikko et al.

[11] Patent Number: 4,501,526

[45] Date of Patent: Feb. 26, 1985

[54] APPARATUS FOR CONVEYING A SOLID OR LIQUID MATERIAL, ESPECIALLY FOR CHARGING A SHAFT FURNACE

[75] Inventors: Matti J. Kuusikko, Ulvila; Olavi K. Rantala, Pori, both of Finland

[73] Assignee: Outokumpu Oy, Outokumpu, Finland

[21] Appl. No.: 581,217

[22] Filed: Feb. 22, 1984

[30] Foreign Application Priority Data

Aug. 21, 1979 [FI] Finland ..... 792605

[51] Int. Cl.[3] ..... C21B 7/16

[52] U.S. Cl. ..... 414/173; 294/68.26; 414/207; 414/392; 414/424

[58] Field of Search ..... 414/172, 173, 191, 192, 414/199, 182, 391, 654, 655, 207, 392, 424; 294/73

[56] References Cited

U.S. PATENT DOCUMENTS

| | | | |
|---|---|---|---|
| 1,569,501 | 1/1926 | Kinney | 414/654 |
| 2,211,719 | 8/1940 | Gerosa et al. | 414/424 |
| 3,374,907 | 3/1968 | Phillips et al. | 294/73 X |
| 3,502,233 | 3/1970 | Mevissen et al. | 414/173 |
| 4,039,090 | 8/1977 | Desourdy | 414/391 X |

*Primary Examiner*—Robert G. Sheridan

*Attorney, Agent, or Firm*—Brooks, Haidt, Haffner & Delahunty

[57] ABSTRACT

The present invention is concerned with a conveying apparatus especially to be used for charging a shaft furnace. The apparatus comprises a transferring device consisting of at least one carriage accommodating at least two skips with open tops. At the upper part of the skip there is, or can be attached a lifting handle. The skips are lifted to the emptying position by a lifting device including locking bars and a locking device. The locking bars are situated in relation to the pouring lip of the skip, on the opposite side of the transverse vertical plane bisecting the center of gravity, in order to tilt the skip around the locking bar.

4 Claims, 1 Drawing Figure

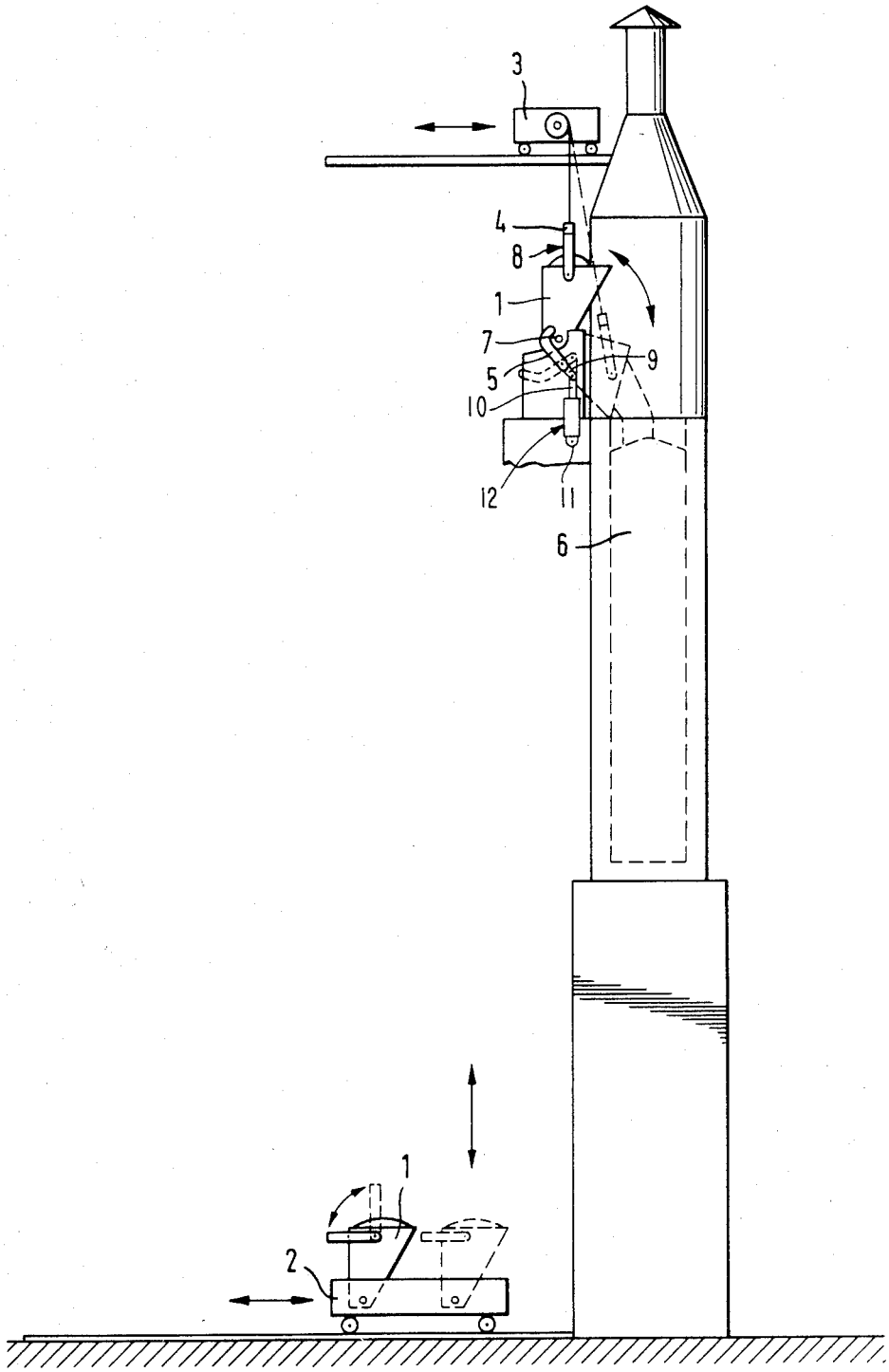
3
4
8
1
7
9
5
10
12
11
6
1
2

APPARATUS FOR CONVEYING A SOLID OR LIQUID MATERIAL, ESPECIALLY FOR CHARGING A SHAFT FURNACE

This application is a continuation of application Ser. No. 178,547, filed Aug. 15, 1980, now abandoned.

BACKGROUND OF THE INVENTION

1. Field of the Invention

The present invention relates to an apparatus for conveying a solid or liquid material, especially for charging a shaft furnace.

Description of the Prior Art

The charging apparatus for a shaft furnace has traditionally consisted of endless conveyors (e.g. dog conveyors). The object of the present invention is to improve the charging of a shaft furnace so as to achieve effective and flexible conveyance of material.

SUMMARY OF THE INVENTION

The present invention provides a conveying apparatus of the charactor once described, which comprises at least two skips with open tops, where at the upper part of the skip there is, or can be attached a lifting handle, a device for transferring the skips between a filling and an emptying position, the device comprising at least one carriage accommodating at least two skips simultaneously, the device including a lifting device, for raising the skip to the emptying position, having locking bars and locking means for locking the bars into the emptying position, the locking bars being situated in relation to the pouring lip of the skip, on the opposite side of the transverse vertical plane bisecting the center of gravity, in order to tilt the skip around the locking bar when the lifting handle is lowered.

In one embodiment of the invention, there is a lifting handle fitted pivotably at the upper edge of each skip, and locking bars have been attached to the skip. It is also possible to fit the locking bars to the lifting handle, in which case the lifting handle extends over the skip edge to its sides and can be attached non-pivotably to the skip. Another feasible alternative is that the attachment point of the lifting handle to the upper edge of the skip pivots at the pouring stage. A detachable lifting handle provides the advantage that no lifting handles need to be fitted to the skip but the lifting handle constitutes a part of the lifting device.

DESCRIPTION OF THE DRAWING

The invention is described in more detail with reference to the accompanying drawing, which shows an overall schematic side view of a conveying apparatus according to the present invention, and in which drawing dashed lines are used to show hidden parts and different positions of parts during a conveying operation.

A skip carriage 2 accommodating two charging skips 1 moves along rails at the floor level of the raw materials storage. This carriage can be directed to the desired point on the rails by means of a control switch. The skip carriage has one steel charging skip 1 which is filled with the raw material to be charged. The skip carriage 2 with its skip 1 is thereafter driven to a position adjacent to the shaft furnace. The charger attaches the full skip 1 to the cables of the chargelifting device 3 by means of the lifting bar 4. The lifting device is an automatically operated twin-cable bogie which moves along two rails fixed to the ceiling. The lifting bar 4 raises the skip from the carriage to the charging platform, which is at a higher level. Here the lifting bar 4 transfers the skip 1 to a position next to the charge inlet in the side of the shaft furnace 6. The skip is locked by means of pneumatically operated locking levers 5 which lock onto the locking bars 7 at the lower end of the skip. Thereafter the lifting device begins to give slack to the skip, and thereby the skip is tilted under the effect of its shape and weight into the charge inlet of the shaft furnace, and the raw material falls into the furnace.

The lifting device 3 raises the emptied skip 1 to an upright position, the locking levers 5 open and the lifting device returns the empty skip to the same position on the carriage 2 from which the skip was lifted.

While the lifting device carries out its charging cycle the charger fills the skip emptied during the previous cycle and drives the carriage 2 back to the position adjacent to the shaft furnace.

The charger detaches the empty skip 1 from the lifting device 3, drives the lifting device to the full skip, attaches it, and dispatches the lifting device on its next cycle.

As shown, the locking lever 5 can have a projection 9 which extends beyond the pivoting point of the lever 5. A cylinder 12 is pivoted at its lower end to the body of the furnace as indicated by reference numeral 11, and the piston shaft 10 of the cylinder 12 is pivotally attached to the projection 9. Thus, when the locking lever 5 is to be locked in order to lock the skip in place, the cylinder is attached so that the shaft 10 moves downward and thereby lifts the lever 5 upwards and into locking position. To unlock, the operation is effected in reverse.

What is claimed is:

1. In a furnace installation comprising a furnace with a base and a charge inlet above the base, the combination therewith of apparatus for supplying material for charging said furance to said charge inlet, said apparatus comprising:

at least one skip for receiving said material, each said skip comprising a locking bar disposed with respect to the center of gravity of said skip so that when the skip is held by only said locking bar, the skip will tilt and discharge its contents;

a carriage movable between a material receiving position spaced from the base of said furnace and a position at the base of said furnace for carrying the skip between the material receiving position and the position at the base of the furnace;

lifting means for lifting each said skip from its position at the base of said furnace to adjacent said charge inlet, said lifting means comprising a handle engaging the skip and preventing tilting of the skip, as it is lifted, by an amount sufficient to discharge material therefrom, but permitting tilting of the skip, when the skip is held by the locking bar, without requiring movement of the handle with respect to the skip in the direction of lifting; and locking means at said charge inlet for engaging said locking bar and holding the skip thereby, whereby the skip may be lifted by said handle from said carriage when it is at the base of the furnace and raised to adjacent the charge inlet with the locking bar in engagement with the locking means and thereafter, tilted to discharge said material into the charge inlet by removing the lifting force from said handle, said locking means comprising a movable member which is movable into a first position in which it is engageable with said locking bar and which is movable into a second position in which the member is out of the path of movement of said locking bar, and further comprising pneumatic means connected to said member for moving the latter between its first and second positions, said locking means comprising a surface which slopes downwardly away from the charge inlet and which is engageable with said locking bar, said member, in its first position, preventing movement of said locking bar along said surface.

2. A furnace installation according to claim 1 wherein said handle is pivotally connected to the skip at a point on the latter above the center of gravity of the skip.

3. A furnace installation according to claim 2 wherein said locking bar is connected to the skip at a point on the latter which is below, and offset with respect to a vertical plane intersecting, the center of gravity of the skip.

4. A furnace installation according to claim 1 wherein two skips are mounted on said carriage and said carriage is reciprocable between the material receiving position and the position at the base of the furnace whereby an empty skip can be returned to the material receiving position while another skip is lifted from the carriage.

* * * * *

UNITED STATES PATENT AND TRADEMARK OFFICE

CERTIFICATE OF CORRECTION

PATENT NO. : 4,501,526

DATED : February 26, 1985

INVENTOR(S) : Matti J. Kuusikko; Olavi K. Rantala

It is certified that error appears in the above-identified patent and that said Letters Patent is hereby corrected as shown below:

Column 2, line 30:

"cylinder is attached" should read: --cylinder is actuated--.

Signed and Sealed this

*Second* Day of *July 1985*

[SEAL]

*Attest:*

DONALD J. QUIGG

*Attesting Officer*

*Acting Commissioner of Patents and Trademarks*